US005967599A

United States Patent [19]

Cauffiel

[11] Patent Number: 5,967,599

[45] **Date of Patent: *Oct. 19, 1999**

[54] CABINET AND TABLE ASSEMBLY FOR USE WITH SEATING APPARATUS

[76] Inventor: Ford B. Cauffiel, 4126 Nantucket Dr., Toledo, Ohio 43623

[ * ] Notice: This patent is subject to a terminal disclaimer.

[21] Appl. No.: 09/193,640

[22] Filed: Nov. 17, 1998

Related U.S. Application Data

[63] Continuation of application No. 08/790,726, Jan. 31, 1997, Pat. No. 5,839,780.

[51] Int. Cl.[6] ..... A47B 39/00

[52] U.S. Cl. ..... 297/135; 312/235.8; 312/277

[58] Field of Search ..... 297/217.1, 135, 297/174, 173; 312/208.1, 235.8, 233.3, 277; 108/49, 139, 140, 141, 147, 147.19; 248/157, 404

[56] References Cited

U.S. PATENT DOCUMENTS

| | | |
|---|---|---|
| 591,440 | 10/1897 | Washington . |
| 1,590,586 | 6/1926 | McDonald . |
| 2,523,425 | 9/1950 | Gargaglione . |
| 3,179,071 | 4/1965 | Johnston . |
| 3,520,583 | 7/1970 | Case . |
| 4,979,718 | 12/1990 | Bauer et al. . |
| 5,503,086 | 4/1996 | Hoffman et al. . |
| 5,526,756 | 6/1996 | Watson . |
| 5,577,818 | 11/1996 | Sayre . |
| 5,597,199 | 1/1997 | Hoffman et al. . |
| 5,651,594 | 7/1997 | Lechman . |

FOREIGN PATENT DOCUMENTS

| | | |
|---|---|---|
| 8810081 | 12/1988 | WIPO . |

*Primary Examiner*—Milton Nelson, Jr.
*Attorney, Agent, or Firm*—Marshall & Melhorn

[57] ABSTRACT

A cabinet with a movable table on top is designed for use with seating apparatus, such as a chair. The cabinet and table can particularly be used with computer systems although they can also be used for eating or reading. The table can slide between extended and retracted positions relative to the chair. It can also be pivoted between a working position and an out-of-the-way position. The table can also be employed with both sliding and pivotal movements. A computer processing unit can be located in the cabinet along with a counterweight to offset the weight of the table and any load thereon, particularly when in the extended position.

8 Claims, 6 Drawing Sheets

CABINET AND TABLE ASSEMBLY FOR USE WITH SEATING APPARATUS

RELATED APPLICATION

This application is a continuation of U.S. patent application Ser. No. 08/790,726 filed Jan. 31, 1997, now U.S. Pat. No. 5,839,780.

FIELD OF THE INVENTION

This invention relates to a cabinet and table assembly for use with seating apparatus, such as a chair.

SUMMARY OF THE INVENTION

The table can be used to support a food tray or reading material, but is particularly designed for use with a computer system. The cabinet can contain a computer processing unit (CPU) and also has a counterweight to offset the weight of the table and any load thereon, particularly when in an extended position cover the seating apparatus or chair. The table is located above the cabinet and is mounted for sliding movement, pivotal movement, or both, relative to the chair. The height of the table can also be adjusted for a particular user. A keyboard can be slidably mounted under the table or located in a shallow recess on the top of the table, if desired.

It is, therefore, a principal object of the invention to provide a cabinet with a movable table suitable for use with seating apparatus.

Another object of the invention is to provide a cabinet and movable table designed particularly for use with computer systems.

BRIEF DESCRIPTION OF THE DRAWINGS

Many other objects and advantages of the invention will be apparent from the following detailed description of preferred embodiments thereof, reference being made to the accompanying, somewhat schematic drawings, in which.

DETAILED DESCRIPTION OF THE PREFERRED EMBODIMENT

Figure 1:
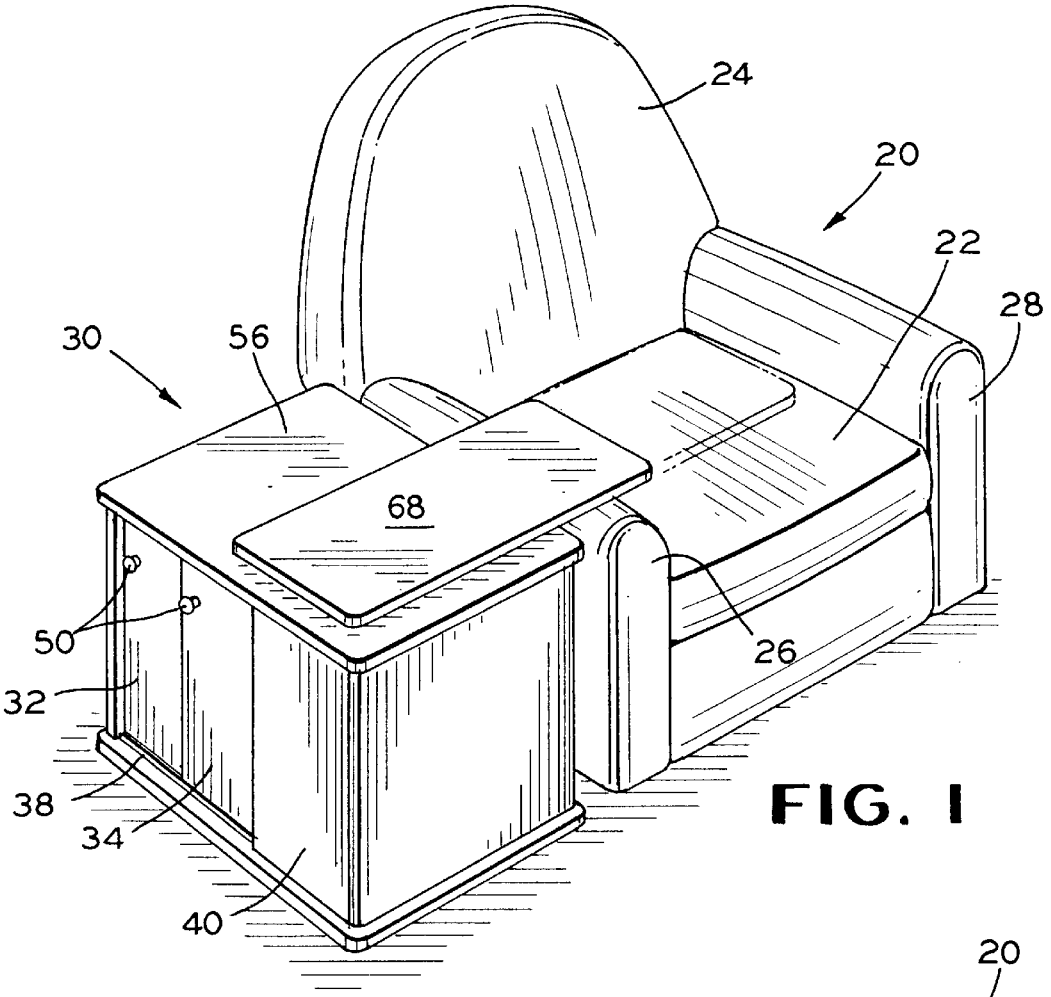
FIG 1. is a view in perspective of a cabinet and movable table according to the invention, and seating apparatus.
Figure 2:
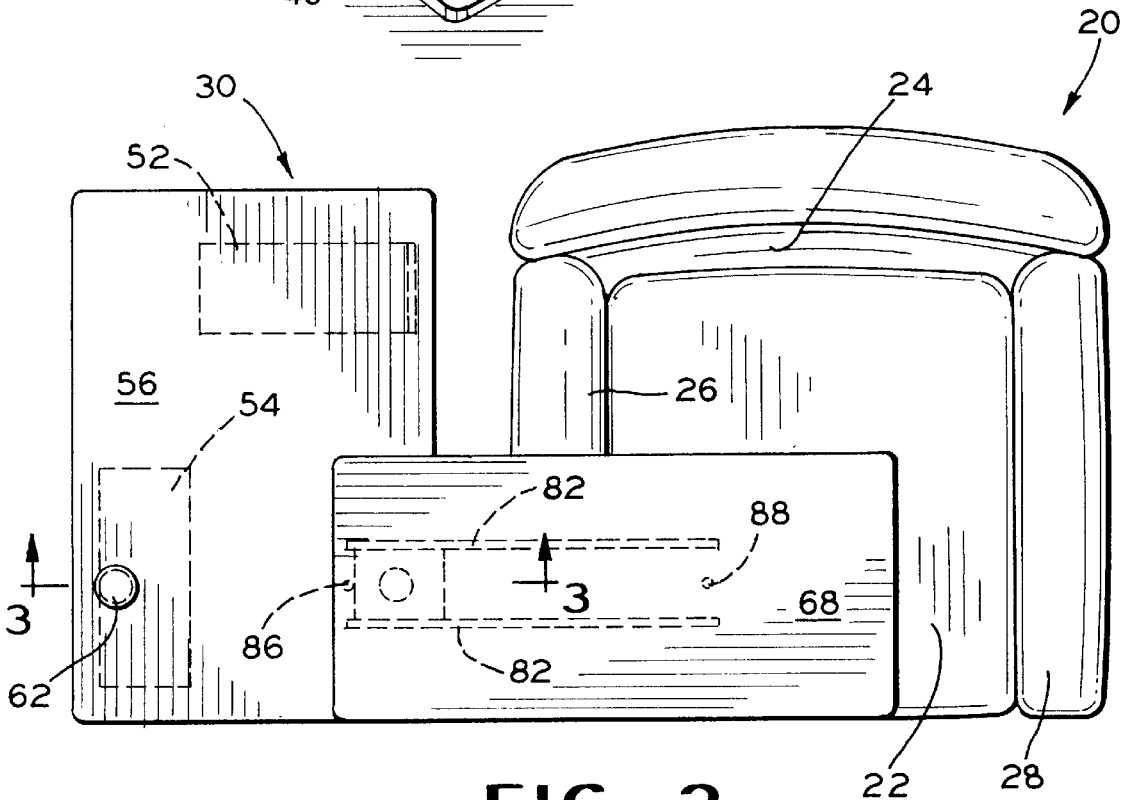
FIG. 2 is a top view of the cabinet with the table in an extended position, and seating apparatus.

Referring particularly to FIGS. 1 and 2, seating apparatus for use with the invention is shown in the form of a chair 20. The chair includes a seat 22, a back 24, and arms 26 and 28.

The cabinet 30 is shown near the chair arm 26, in this instance. The cabinet 30 includes sliding doors 32 and 34 mounted in upper and lower tracks 36 and 38 (FIG. 3) at an outer side wall 40 of the cabinet 30. Also, sliding doors 42 and 44 in an upper track (not shown) and a lower track 46 are located at an inner side wall 48. The doors have handles or knobs 50 (FIG. 1).

Figure 3:
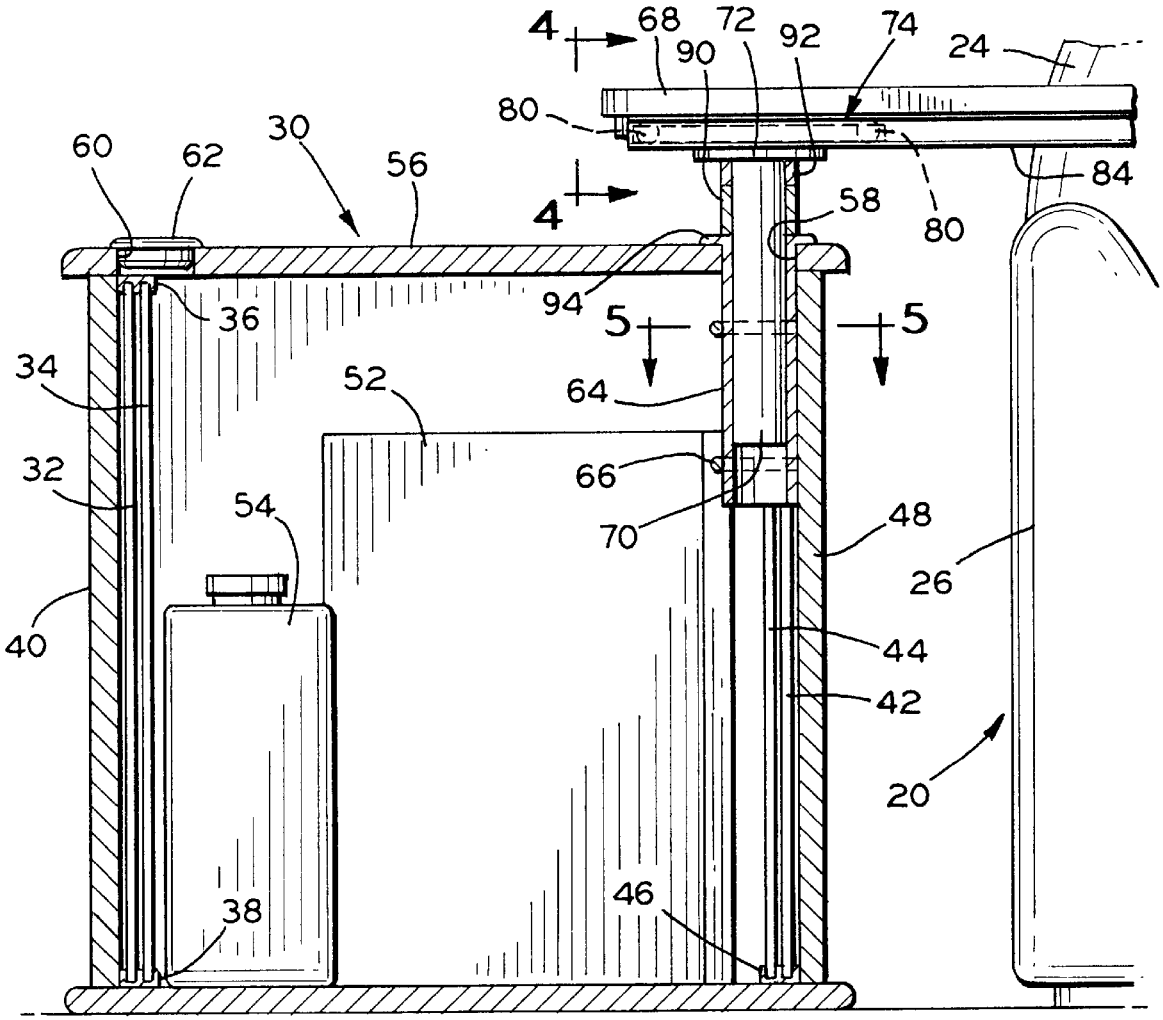
FIG. 3 is an enlarged view in vertical section taken along the line 3—3 of FIG. 2.

As shown in FIGS. 2 and 3, the cabinet 30 contains a computer processing unit (CPU) 52 and a counterweight 54, shown in the form of a container which can contain sand or water.

Figure 5:
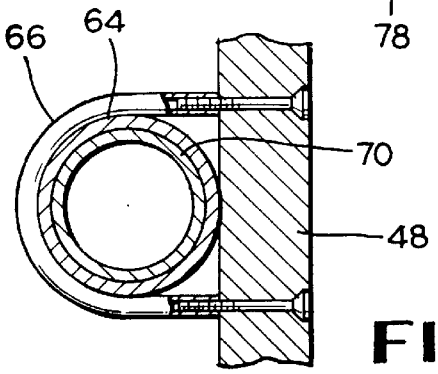
FIG. 5 is a fragmentary, sectional view taken along the line 5—5 of FIG. 3.

A top 56 of the cabinet 30 has spaced openings 58 and 60 near the side walls 48 and 40. As shown, the opening 60 has a plug 62 therein for appearance purposes when the opening 60 is not in use. An outer sleeve 64 (FIGS. 3 and 5) extends through the opening 58 and is held against the inner surface of the side wall 48 by U-bolts 66 or other suitable fasteners.

A table 68 is located above the cabinet 30 and can move between a retracted position, as shown in solid lines in FIG. 1, and an extended, working position as shown in dotted lines in FIG. 1.

Figure 4:
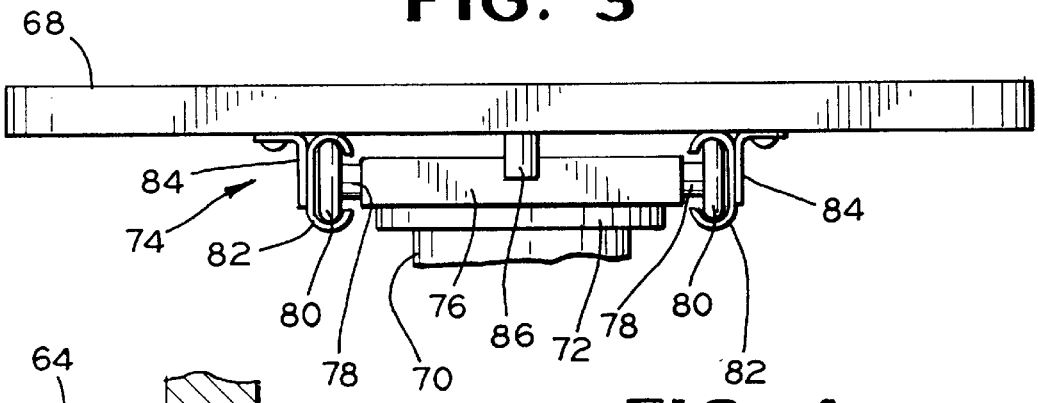
FIG. 4 is an end view showing the table and slide mechanism taken along the line 4—4 of FIG. 3.

A post or inner sleeve 70 (FIGS. 3 and 5) is located in the outer sleeve 64 and extends upwardly to a mounting flange 72 which supports a slide 74 (FIG. 4). The outer sleeve 64 holds the post 70 to prevent transverse movement thereof. The slide 74 includes a block or plate 76 which carries axles 78 on which rollers 80 are rotatably mounted. The rollers 80 are located in tracks 82 which are affixed to flanges 84 fastened to the bottom of the table 68. Suitable stops 86 and 88 (FIGS. 2 and 4) extend from the bottom of the table 68 to limit sliding movement of the table between the retracted and working positions.

As shown in FIG. 3, two adjusting spacers 90 and 92 are located around the post 70 and between the flange 72 and the upper end of the outer sleeve 64 which has a flange 94. The spacers 90 and 92 preferably are of different lengths to adjust the height of the table 68 above the top 56 of the cabinet 30 when the spacers are removed or added.

Figure 6:
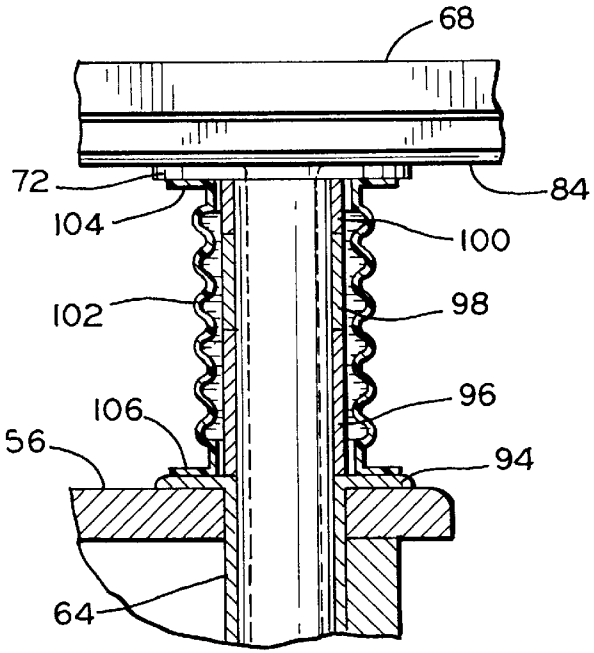
FIG. 6 is an enlarged fragmentary view in section of a table and cabinet with height adjustment.

Additional spacers can be employed for additional height adjustment, if desired. Referring to FIG. 6, three adjusting spacers 96, 98, and 100 are located around the post 70 and between the flange 72 and the flange 44 of the outer sleeve 64. Again, these spacers can be of different lengths. Particularly for appearance purposes, a bellows is located around the spacers 96, 98, and 100. The bellows can be placed under compression with an upper flange 104 bearing against the mounting flange 72 and a lower flange 106 bearing against the flange 94 of the outer sleeve 64. With this arrangement, the table 68 can be pivoted with the flanges 104 and 106 then sliding on the flanges 72 and 94. The inner sleeve 70 can rotate in the outer sleeve 64 as the table pivots.

Figure 7:
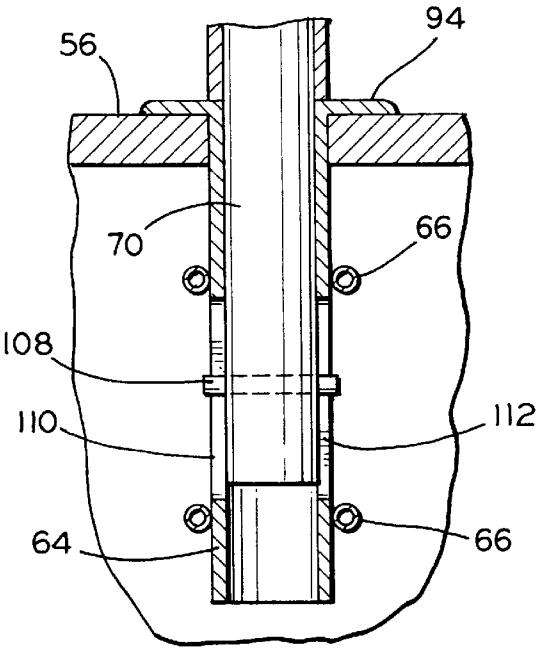
FIG. 7 is a fragmentary view in section of a cabinet top and supporting means for preventing pivotal movement of the table.
Figure 9:
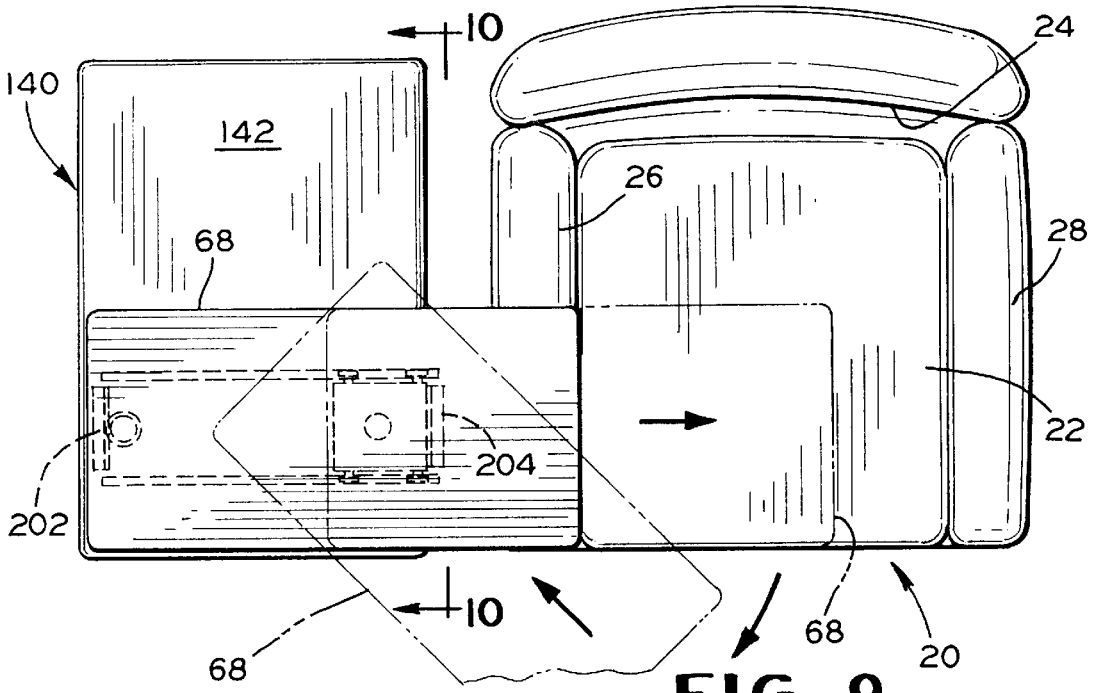
FIG. 9 is a top view of a modified cabinet and table along with seating apparatus, with the table shown in two positions in dotted lines.
Figure 10:
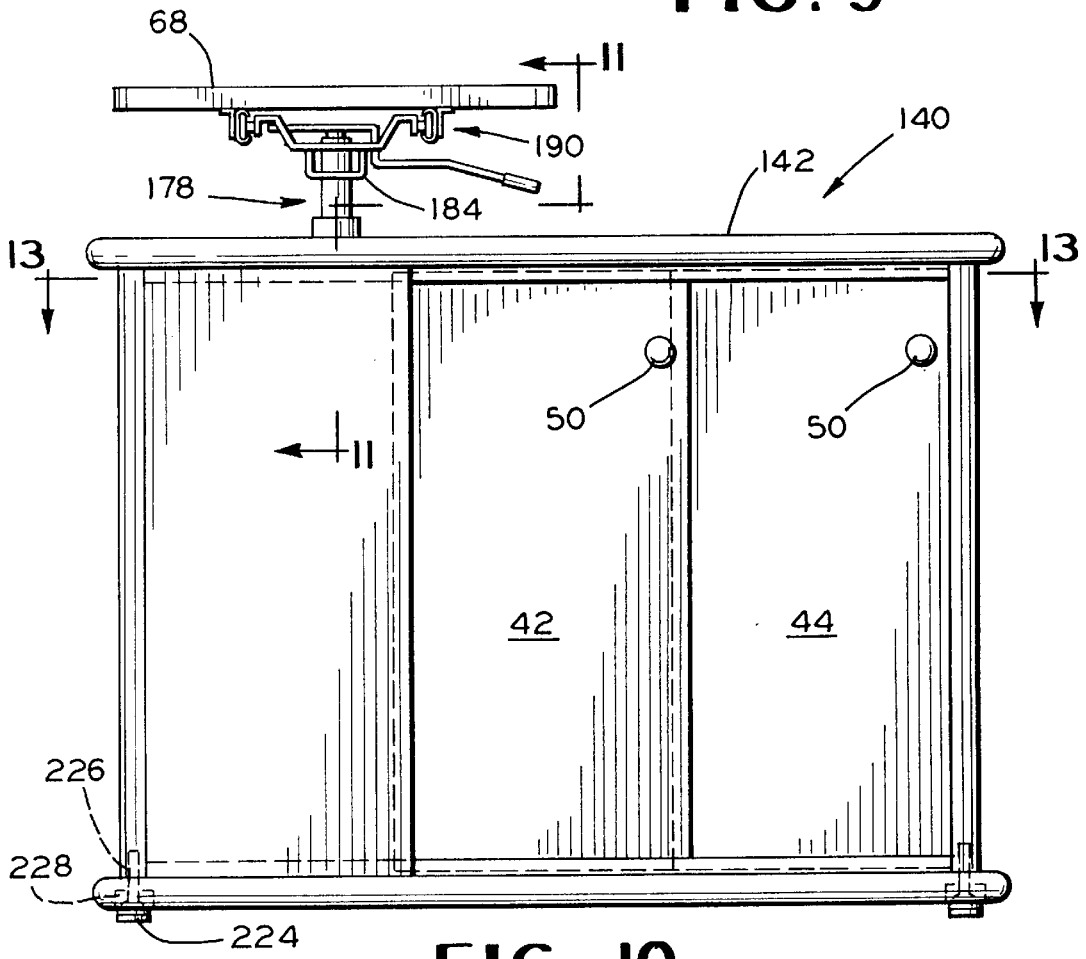
FIG. 10 is a view in elevation of the cabinet and table of FIG. 9 with modified height adjustment mechanism.

In some instances, it may be desirable not to enable the table 68 to pivot. In that instance, the modification of FIG. 7 can be employed. Here, a pin 108 is affixed to the post 70 and extends into slots 110 and 112 formed in the outer sleeve 64. The outer sleeve 64 is held in a fixed position by the fasteners or U-bolts 66 and the table 68 is thereby prevented from pivoting. The slots 110 and 112 enable the post 70 to be raised or lowered by the adjusting spacers.

Figure 8:
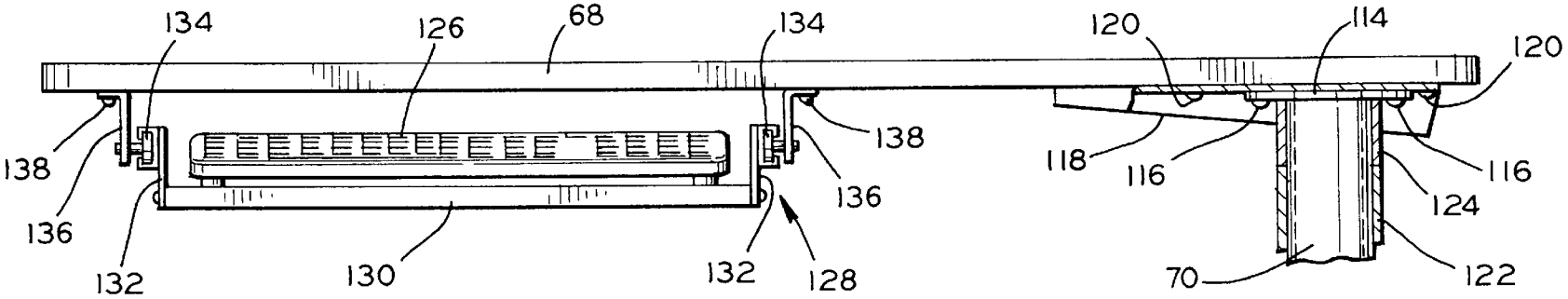
FIG. 8 is a fragmentary view in elevation, with parts in section, of a table with a keyboard slidably mounted thereunder.

In some instances, it is desired not to enable the table to slide. Referring to FIG. 8, the table 68 is supported by the inner sleeve or post 70 through a flange 114 which has fasteners 116 affixed to the table through a bracket 118. The bracket 118 is also affixed to the table 68 through suitable fasteners 120. The inner sleeve 70 can pivot in the outer sleeve 64 (not shown in FIG. 8) with adjusting spacers 122 and 124 located below the flange 114.

In this modification, a keyboard 126 can be located under the table 68 and moved beyond the edge of the table for access. For this purpose, a slide 128 includes a smaller table or tray 130 supported by brackets 132 which engage rollers 134. Brackets 136 rotatably hold the rollers 134, with two spaced rollers located on each side of the slide 128. The brackets 136 are fastened to the bottom of the table through suitable fasteners 138.

Another embodiment of the invention is shown in FIGS. 9–13. In particular, this embodiment shows a different height adjustment and a different counterweight, both of which will be discussed subsequently. Seating apparatus in the form of the chair 20 is again shown, and a cabinet 140 similar to the cabinet 30 of the first embodiment except having a top 142 which has openings 144 and 146 spaced farther from the edges of the top 142 than the openings in the top of the embodiments of FIGS. 1–7. Again, the opening 146 has a plug 148 therein for appearances when this opening is not in use.

A sleeve or tube 150 (FIGS. 11 and 13) has an upper flange 152 attached to the bottom of the cabinet top 142 around the opening 144 by suitable fasteners 154. The sleeve 150 is of square configuration in transverse cross section. A horizontal arm 156 is affixed to a lower portion of the sleeve 150 and extends to a front wall 158 of the cabinet 140. The arm 156 is attached to the front wall by a flange 160 and fasteners 162.

Figure 11:
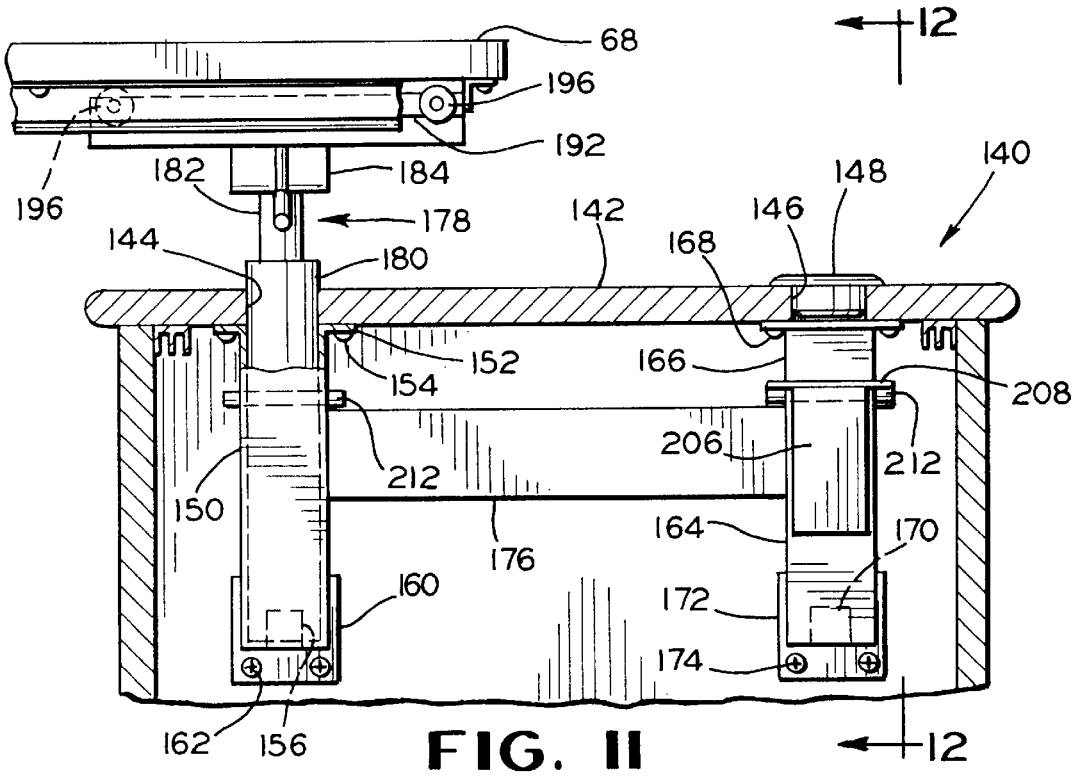
FIG. 11 is a fragmentary view in section taken along the line 11—11 of FIG. 10.
Figure 12:
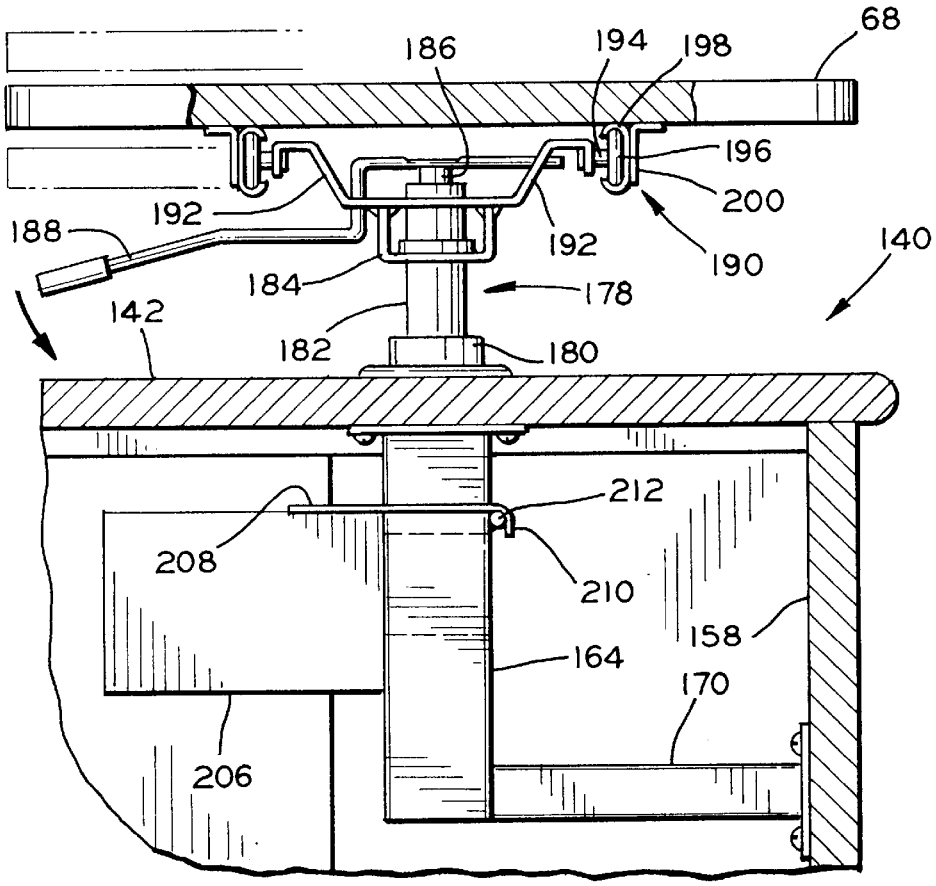
FIG. 12 is an enlarged view in section of the cabinet, table, and height adjustment mechanism, taken along the line 12—12 of FIG. 11.
Figure 13:
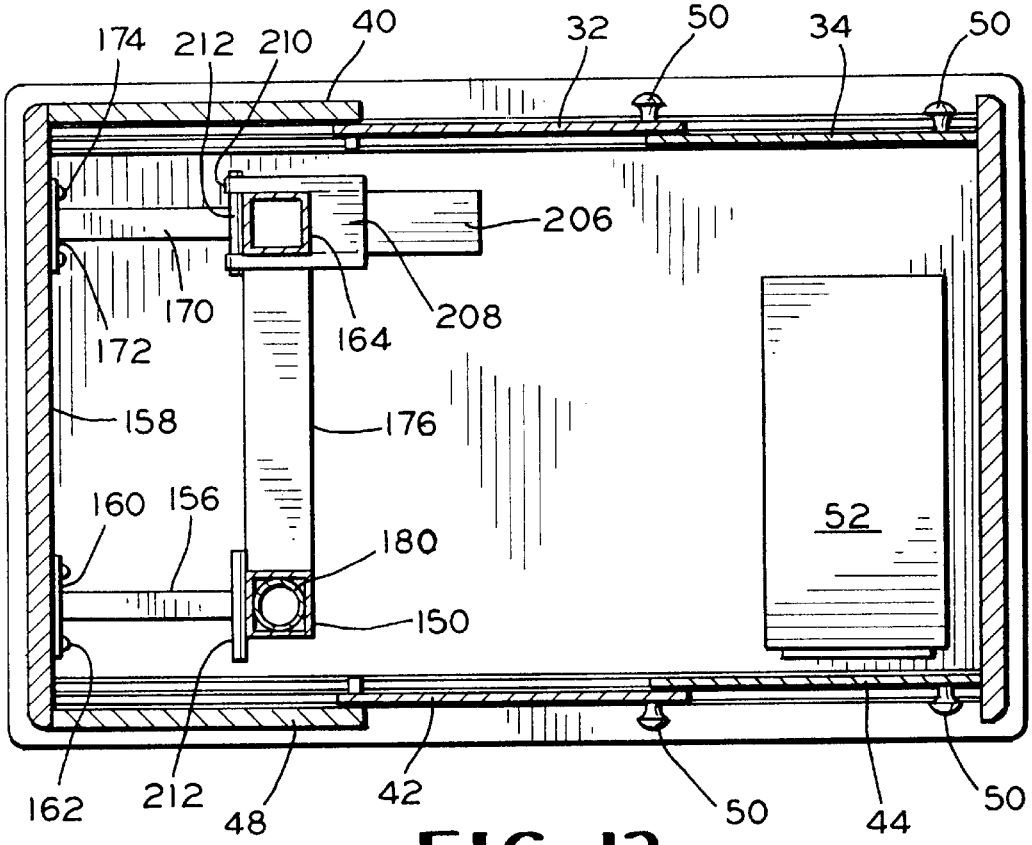
FIG. 13 is a view in horizontal cross section taken along the line 13—13 of FIG. 10.

A second square sleeve or tube 164 has a flange 166 at its upper end which is attached to the bottom of the cabinet top 142 around the openings 146 by suitable fasteners 168. A horizontal arm 170 is affixed to a lower portion of the sleeve 164 and is attached to the front wall 158 by a flange 172 and fasteners 174. As best shown in FIGS. 11 and 13, the sleeves 150 and 164 are connected by a rigid connecting arm 176.

A pneumatic or gas height adjuster indicated at 178 (FIGS. 10–12) is used to adjust the height of the table 68. This is an automatic device which is commercially available and is commonly used on office chairs. The adjuster includes a gas cylinder 180 which is located in the sleeve 150 and extends above the cabinet top 142. The sleeve 150 holds the cylinder 180 and prevents transverse movement of the adjuster 178. A cylinder rod or post 182 extends upwardly from the cylinder 180 and has an intermediate portion affixed to a mounting bracket 184. A valve button 186 projects from the upper end of the post 182 and opens a valve in the adjuster 178 when depressed by a lever 188. When the valve is depressed, the table 68 can be moved up or down to the desired height where it stays when the lever is released.

The mounting bracket 184 supports a slide 190 through wide arms 192 which carry axles 194 on which rollers 196 are rotatably 25 mounted. These are located in tracks 198 which are affixed to flanges 200 fastened to the bottom of the table 68. The lever 188 extends through slots in the arms 192. Suitable stops 202 and 204 limit the movement of the table between its retracted and working positions (see FIG. 9). The table 68 can also pivot, as shown in dotted lines in FIG. 9.

A counterweight 206 is located in the cabinet 142. The counterweight is in the form of a heavy block of metal, steel. A supporting plate 208 is affixed to the top of the block 206 and has downwardly-extending hooks 210 which extend over heavy mounting pins 212 affixed to sides of both of the sleeves 150 and 164. As shown in FIG. 11, the counterweight 206 is spaced a substantial distance from the height adjuster and table to provide an effective counterweight for the table and any load carried thereon.

Figure 14:
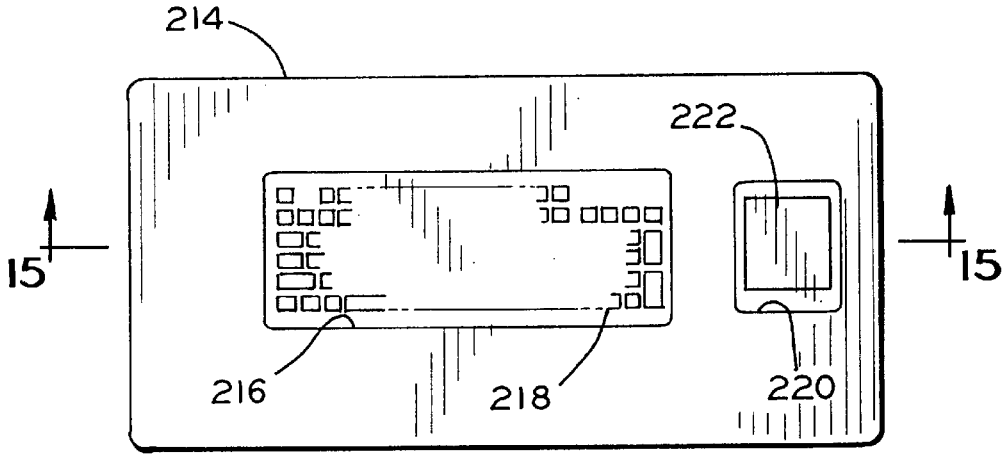
FIG. 14 is a top view of a modified table.
Figure 15:
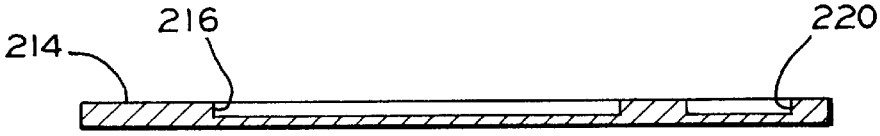
FIG. 15 is a view in longitudinal cross section taken along the line 15—15 of FIG. 14.

Referring to FIGS. 14 and 15, a modified table 214 is shown. This table has a shallow central recess 216 to receive a keyboard 218. The table also has a smaller shallow recess 220 to receive a mouse 222.

As shown in FIG. 13, the computer processing unit (CPU) 52 is also located in the cabinet 140 and is accessible to the user through the cabinet doors.

If desired, the cabinet 140 can have leveling feet 224 (FIG. 10) which are raised or lowered by turning threaded shanks 226 into or out of internally-threaded T-nuts 228 located in the bottom corners of the cabinet.

All of the embodiments of the invention can be used on either the left-hand or the right-hand side of the chair 20.

When the cabinet 30 of FIGS. 1–6 is employed on the opposite side of the chair, near the arm 28, the table and post along with the outer sleeve are located in the opening 60 and the plug 62 placed in the opening 58. The CPU 52 is then moved toward the other side of the cabinet to be accessible through the doors 34 and 36 and the counterweight is moved to the wall 48.

With the embodiment of FIGS. 9–13, when the cabinet 140 is moved to the other side of the chair near the arm 28, the lift adjuster 178 is placed in the opening 146 and the plug 148 is placed in the opening 144. The counterweight 206 is then hooked on the pin 212 that is affixed to the square sleeve 150. Similarly, the CPU 52 is moved to the other side of the cabinet to be accessible through the other sliding doors.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. In combination, seating apparatus supported on a floor, a cabinet supported on the floor adjacent said seating apparatus, a movable table above a top of said cabinet, said top having an opening therein, support means supporting an end portion of said table and extending downwardly through said opening in said top, said support means having height adjustment means to vary the height of the table, said height adjustment means comprising a gas-operated lift mechanism having a cylinder extending downwardly through said opening, said gas-operated lift mechanism having a cylinder rod extending above said cabinet, said cylinder rod having a mounting bracket for supporting said table, said gas-operated lift mechanism being operable to raise and lower said table and maintain same in a desired fixed position above said cabinet.

2. The combination according to claim 1 wherein a slide has a portion affixed to the bottom of said table and a portion affixed to an upper end of said support means to enable said table to move between a retracted position clearing a seat of said seating apparatus and an extended position above the seat of said seating apparatus.

3. The combination according to claim 1 wherein said gas-operated lift mechanism has a lever which can be manipulated to enable said table to be raised and lowered when the lever is operated, the table remaining in a fixed position when the lever is released.

4. The combination according to claim 1, wherein engaging means are located in said cabinet engaging a lower portion of said support means, and a counterweight in said cabinet spaced from said engaging means to counterbalance the weight of said table and any load thereon.

5. The combination according to claim 1, wherein a keyboard tray is mounted under the table for sliding movement between a retracted position under the table and an extended position extending beyond a side edge of the table.

6. The combination according to claim 1, wherein said table has a shallow recess in an upper surface thereof for receiving a keyboard.

7. In combination, seating apparatus supported on a floor, a cabinet supported on the floor near one side of said seating apparatus, a movable table above a top of said cabinet, said top having an opening therein, support means supporting an end portion of said table and extending downwardly through said opening in said top, said support means having height adjustment means to vary the height of the table, said height adjustment means comprising a gas-operated lift mechanism having a cylinder extending downwardly through said opening, said gas-operated lift mechanism having a cylinder extending downwardly through said opening, said gas-operated lift mechanism having a cylinder rod extending above said cabinet, said cylinder rod having a mounting bracket for supporting said table, said gas-operated lift mechanism having a valve button and means for operating said valve button so that said table can be raised and lowered when said button is operated with the table remaining in a fixed position when said button is released.

8. The combination according to claim 7 wherein said table is pivotable relative to said cabinet top.

* * * * *